US011183126B2

(12) United States Patent
Saito

(10) Patent No.: US 11,183,126 B2
(45) Date of Patent: Nov. 23, 2021

(54) DEVICE AND METHOD FOR MURA CORRECTION

(71) Applicant: SYNAPTICS INCORPORATED, San Jose, CA (US)

(72) Inventor: Satoshi Saito, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 45 days.

(21) Appl. No.: 16/581,006

(22) Filed: Sep. 24, 2019

(65) Prior Publication Data

US 2020/0111430 A1 Apr. 9, 2020

(30) Foreign Application Priority Data

Oct. 5, 2018 (JP) ..... JP2018-190096

(51) Int. Cl.
*G09G 3/34* (2006.01)

(52) U.S. Cl.
CPC ... *G09G 3/3406* (2013.01); *G09G 2320/0626* (2013.01)

(58) Field of Classification Search
CPC ..... G09G 3/3406; G09G 2320/0626; G09G 3/3685; G09G 3/3275; G09G 2320/0285; G09G 2320/0233; G09G 3/3208; G09G 3/36; G09G 2320/0242
See application file for complete search history.

(56) References Cited

U.S. PATENT DOCUMENTS

2016/0171939 A1* 6/2016 Na ..... G09G 3/20 345/690
2017/0249005 A1* 8/2017 Hwang ..... G09G 3/2092
2019/0371220 A1* 12/2019 Zhou ..... G11C 29/06

* cited by examiner

*Primary Examiner* — Andrew Sasinowski
(74) *Attorney, Agent, or Firm* — Ferguson Braswell Fraser Kubasta PC

(57) ABSTRACT

A display driver comprises a first memory configured to store mura correction data image processing circuitry configured to perform mura correction on image data to be displayed on a display panel based on the mura correction data received from the first memory, and control circuitry configured to detect a first error in the mura correction data received from the first memory. The control circuitry is further configured to control a communication with a second memory storing the mura correction data based on the detection of the first error.

20 Claims, 2 Drawing Sheets

DEVICE AND METHOD FOR MURA CORRECTION

CROSS REFERENCE

This application claims priority to Japanese Patent Application No. 2018-190096, filed on Oct. 5, 2018, the disclosure of which is incorporated herein by reference in its entirety.

BACKGROUND

Field

Embodiments disclosed herein generally relate to a device and method for mura correction.

Description of the Related Art

A production process of a display panel such as an organic light emitting diode (OLED) display panel and a liquid crystal display (LCD) panel may cause variations in the pixel characteristics. The variations in the pixel characteristics may cause mura in a displayed image. Performing mura correction, for example, in a display panel or a driver of the display device may effectively improve the image quality of a displayed image.

SUMMARY

In one or more embodiments, a display driver comprises a first memory, image processing circuitry, and control circuitry. The first memory is configured to store therein mura correction data. The image processing circuitry configured to perform mura correction on image data to be displayed on a display panel based on the mura correction data received from the first memory. The control circuitry is configured to detect a first error in the mura correction data received from the first memory and control a communication with a second memory storing the mura correction data.

In one or more embodiments, a method comprises generating image data to be displayed on a display panel through mura correction based on mura correction data received from a first memory, detecting a first error in the mura correction data received from the first memory, and controlling a communication with a second memory storing the mura correction data based on the detection of the first error.

In one embodiment, a display module comprises a display panel, a first memory configured to store mura correction data, image processing circuitry, and control circuitry. The image processing circuitry is configured to perform mura correction on image data to be displayed on the display panel based on the mura correction data received from the first memory. The control circuitry is configured to detect a first error in the mura correction data received from the first memory, and control a communication with a second memory storing the mura correction data based on the detection of the first error.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
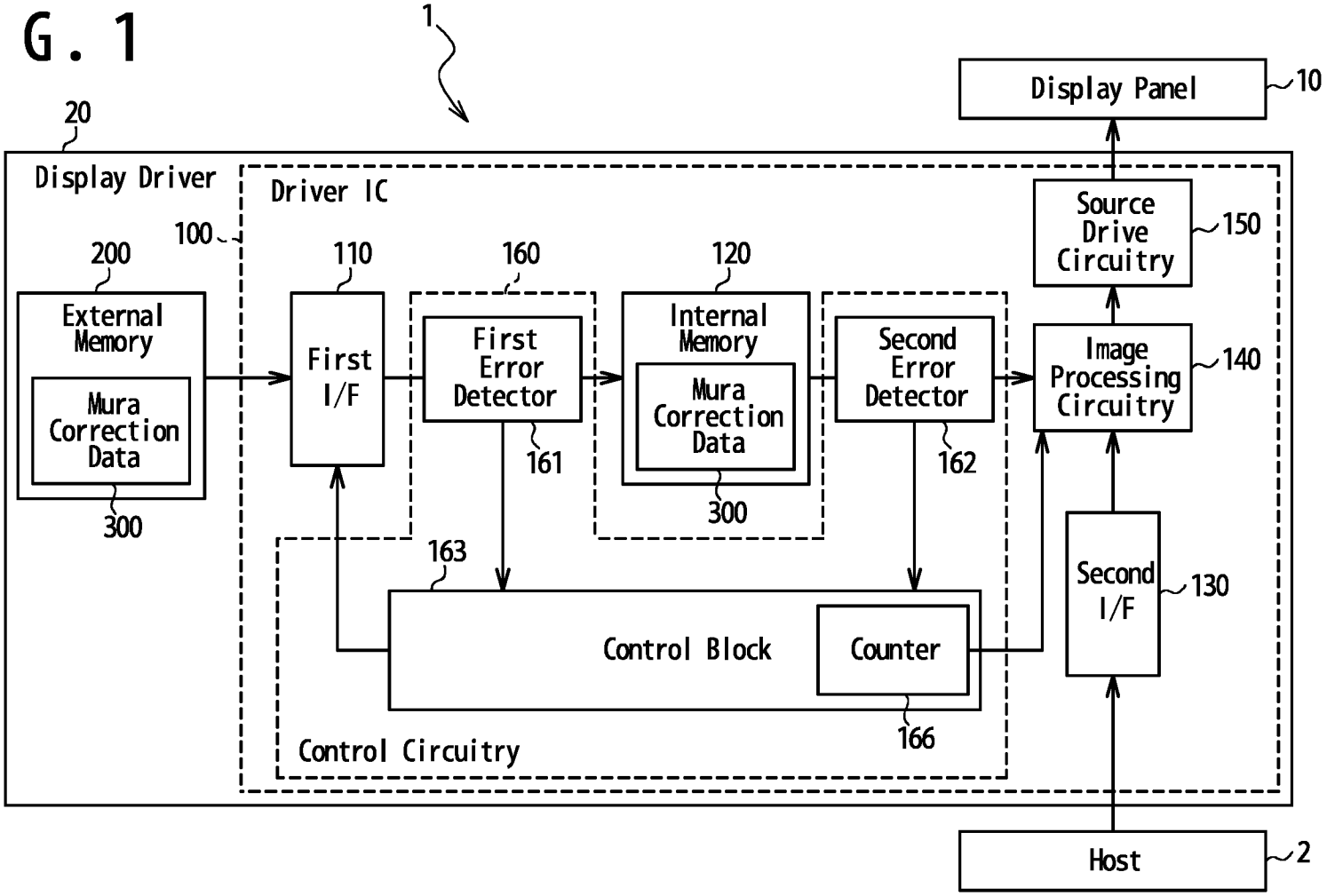
FIG. 1 illustrates one example configuration of a display module, according to one or more embodiments.

In one or more embodiments, as illustrated in FIG. 1, a display module 1 comprises a display panel 10 and a display driver 20. In one or more embodiments, the display driver 20 is configured to receive an input image data from an external host 2 and drive respective pixels of the display panel 10 based on the received input image data to display an image on the display panel 10. Examples of the display panel 10 include an OLED display panel and an LCD panel.

In one or more embodiments, the display driver 20 comprises a driver integrated circuit (IC) 100 and an external memory 200. In one or more embodiments, the driver IC 100 is configured to perform image processing including mura correction on the input image data received from the host 2 to control the display panel 10. The external memory 200 is configured to store therein a mura correction data 300 used for mura correction by the driver IC 100. In one or more embodiments, the mura correction data 300 is written into the external memory 200 in a test process of the display module 1. In one or more embodiments, the external memory 200 is provided outside of the driver IC 100. Examples of the external memory 200 include a non-volatile memory such as a flash memory. In one or more embodiments, the external memory 200 and the driver IC 100 are mounted on the same printed circuit board such as a flexible printed circuit (FPC) board. Alternatively, the external memory 200 may be integrated in the driver IC 100.

In one or more embodiments, the driver IC 100 comprises: a first interface 110, an internal memory 120, a second interface 130, image processing circuitry 140, source driver circuitry 150, and control circuitry 160.

In one or more embodiments, the first interface 110 is configured to communicate with the external memory 200 and receive the mura correction data 300 from the external memory 200. In one or more embodiments, the received mura correction data 300 is transferred to the internal memory 120. Examples of the first interface 110 include a flash memory controller and a serial peripheral interface (SPI.)

In one or more embodiments, the internal memory 120 is configured to, based on an instruction from the host 2, receive the mura correction data 300 from the external memory 200 via the first interface 110 and store the same therein. In one or more embodiments, the internal memory 120 is configured to, at boot and/or at reset, receive the mura correction data 300 from the external memory 200 via the first interface 110 and store the same therein. Examples of the internal memory 120 include a volatile memory such as a static random access memory (SRAM.)

In one or more embodiments, the second interface 130 is configured to receive the input image data from the host 2. In one or more embodiments, the received input image data is transferred to the image processing circuitry 140.

In one or more embodiments, image processing circuitry 140 is configured to perform image processing on the input image data received from the host 2. In one or more embodiments, image processing comprises mura correction based on the mura correction data 300 received from the internal memory 120.

In one or more embodiments, the source driver circuitry 150 is configured to drive the respective pixels of the display panel 10 based on image data obtained through the image processing by the image processing circuitry 140.

In one or more embodiments, the control circuitry 160 is configured to detect an error in the mura correction data 300 to control the first interface 110. In one or more embodiments, the error detection is performed, for example, when the first interface 110 receives the mura correction data 300 and/or when the internal memory 120 outputs the mura correction data 300 to the image processing circuitry 140. In one or more embodiments, the control circuitry 160 is configured to request the external memory 200 for transmission of the mura correction data 300 based on the detection of the error. In one or more embodiments, the control circuitry 160 comprises a first error detector 161, a second error detector 162, and a control block 163.

In one or more embodiments, the first error detector 161 is configured to, when the first interface 110 has received the mura correction data 300 from the external memory 200, detect an error in the received mura correction data 300. In one or more embodiments, the mura correction data 300 is transferred from the first interface 110 to the internal memory 120 via the first error detector 161. In one or more embodiments, the first error detector 161 is configured to check whether there is an error in the mura correction data 300 received from the first interface 110 and output the received mura correction data 300 to the internal memory 120 when no error is found.

In one or more embodiments, the second error detector 162 is configured to, when the internal memory 120 outputs the mura correction data 300 to the image processing circuitry 140, detect an error in the outputted mura correction data 300. In one or more embodiments, the internal memory 120 is configured to output the mura correction data 300 to the image processing circuitry 140 via the second error detector 162. The second error detector 162 is configured to check whether there is an error in the mura correction data 300 received from the internal memory 120 and forward the received mura correction data 300 to the image processing circuitry 140 when no error is found.

In one or more embodiments, the control block 163 is configured to control communications with the external memory 200 based on the detection results by the first error detector 161 and the second error detector 162. In one or more embodiments, the control block 163 is configured to transmit a signal to request the first interface 110 to obtain the mura correction data 300 from the external memory 200 when the first error detector 161 or the second error detector 162 detects an error. This may reduce an influence of the error in the mura correction data 300 on the image data to be displayed.

In one or more embodiments, the control block 163 is configured to count the number of errors detected by the second error detector 162. In one or more embodiments, the control block 163 is configured to control the first interface 110 based on the number of the errors. In one or more embodiments, the control block 163 comprises a counter 166 configured to count the number of the errors.

Figure 2:
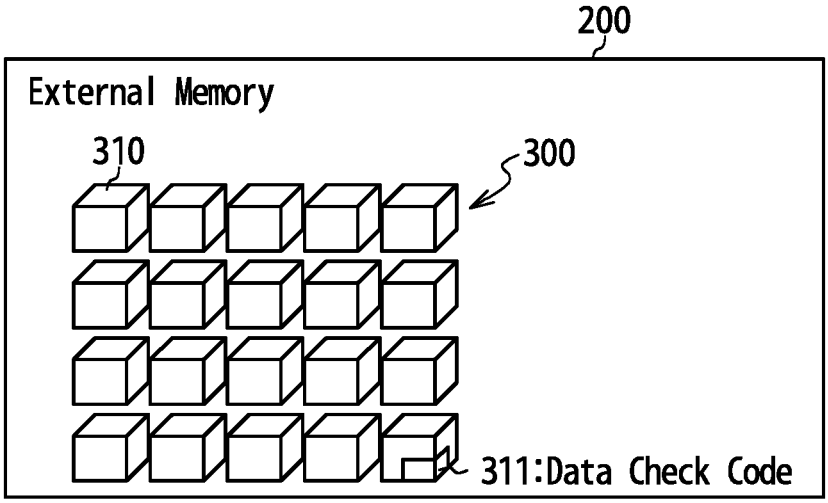
FIG. 2 illustrates example mura correction data, according to one or more embodiments.
Figure 3:
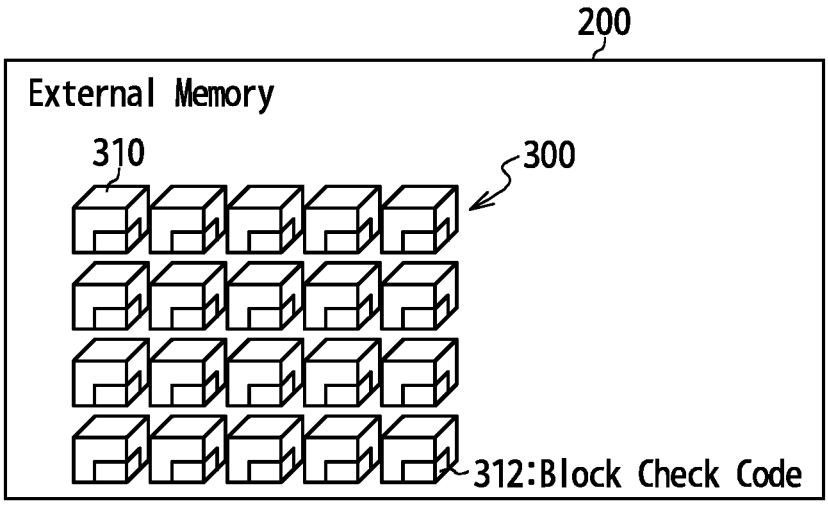
FIG. 3 illustrates example mura correction data, according to one or more embodiments.

FIG. 2 illustrates one example of the mura correction data 300, according to one or more embodiments. In one or more embodiments, the mura correction data 300 comprises a data check code 311. Examples of the data check code 311 include a code for detecting an error in the mura correction data 300, such as a cyclic redundancy code (CRC) and an error correction code (ECC). In one or more embodiments, the data check code 311 is attached with respect to the entirety of the mura correction data 300. In one or more embodiments, as illustrated in FIG. 2, the mura correction data 300 may be segmented into data blocks 310 depending on the readable data size from the external memory 200. In such embodiments, as illustrated in FIG. 3, each data block 310 may comprise a block check code 312 used to detect an error in each data block 310. In one or more embodiments, the first error detector 161 and the second error detector 162 are configured to detect an error based on the data check code 311 and/or the block check codes 312.

In one or more embodiments, the display driver 20 obtains the mura correction data 300 from the external memory 200 and stores the obtained mura correction data 300 in the internal memory 120 before starting a display operation to display an image on the display panel 10, for example at boot-up of the display driver 20.

In one or more embodiments, when the mura correction data 300 is transferred from the external memory 200 to the internal memory 120, the first error detector 161 checks whether there is an error in the transferred mura correction data 300. In one or more embodiments, the first error detector 161 divides the mura correction data 300 into the data check code 311 and a data main body from which the data check code 311 is excluded. In one or more embodiments, the first error detector 161 is adapted to CRC-based error detection, and the first error detector 161 compares a CRC calculated from the data main body of the mura correction data 300 with the data check code 311. In one or more embodiments, the first error detector 161 determines that there is an error in the mura correction data 300 when the calculated CRC is different from the data check code 311. In one or more embodiments, the first error detector 161 outputs the mura correction data 300 to the internal memory 120 when the calculated CRC is identical to the data check code 311. In one or more embodiments, the block check codes 312 are used for error detection, the first error detector 161 divides each data block 310 into the block check code 312 and a data main body from which the block check code 312 is excluded and checks whether there is an error in each data block 310 similarly to the case where the data check code 311 is used.

In one or more embodiments, the control block 163 controls the first interface 110 based on the detection result by the first error detector 161. In one or more embodiments, the control block 163 generates a signal which instructs the first interface 110 to reobtain the mura correction data 300 from the external memory 200 when the first error detector 161 detects an error. The generated signal is outputted to the first interface 110.

In one or more embodiments, the first interface 110 requests the external memory 200 for transmission of the mura correction data 300 based on the signal generated by the control block 163. In one or more embodiments, the mura correction data 300 is transmitted from the external memory 200 to the first error detector 161 and the first error detector 161 checks again whether there is an error in the transmitted mura correction data 300. As thus described, the mura correction data 300 outputted from the external memory 200 is subjected to error detection by the first error detector 161 and transferred to the internal memory 120 before the display operation is started to display an image on the display panel 10, in one or more embodiments.

In one or more embodiments, the mura correction data 300 is transferred from the internal memory 120 to the image processing circuitry 140 when the display driver 20 performs the display operation. In one or more embodiments, when an input image data is supplied from the host 2, the image processing circuitry 140 performs image processing including mura correction based on the mura correction data 300 to generate an image data to be displayed on the display panel 10.

In one or more embodiments, when the mura correction data 300 is transferred from the internal memory 120 to the image processing circuitry 140, the second error detector 162 checks whether there is an error in the transferred mura correction data 300. In one or more embodiments, the operation of the second error detector 162 is similar to that of the first error detector 161. In one or more embodiments, the mura correction data 300 is outputted from the second error detector 162 to the image processing circuitry 140 when the second error detector 162 finds no error in the mura correction data 300.

In one or more embodiments, the control block 163 controls the first interface 110 based on the detection result by the second error detector 162. In one or more embodiments, the operation for the case where the second error detector 162 detects an error is similar to the operation for the case where the first error detector 161 detects an error.

In one or more embodiments, the control block 163 is configured to generate a mura correction stop signal based on the detection result by the second error detector 162. In one or more embodiments, the control block 163 is configured to control the mura correction performed by the image processing circuitry 140 by using the mura correction stop signal. In one or more embodiments, the control block 163 is configured to enable the mura correction stop signal to stop the mura correction, when the second error detector 162 detects an error. In one or more embodiments, the image processing circuitry 140 is configured to generate the image data to be supplied to the source driver circuitry 150 without performing the mura correction on the input image data received from the host 2 when the mura correction stop signal is enabled. In one or more embodiments, this effectively reduces an influence of the error in the mura correction data 300.

In one or more embodiments, the mura correction stop signal is disabled when the second error detector 162 does not detect an error. When the second error detector 162 newly receives a mura correction data 300 free from errors after detecting an error, the control block 163 disables the mura correction stop signal, and the image processing circuitry 140 restarts the mura correction based on the disabling of the mura correction stop signal. In one or more embodiments, the mura correction stop signal may be disabled when the first error detector 161 detects no error in the mura correction data 300 received from the external memory 200 after being once enabled based on an error detection by the second error detector 162.

In one or more embodiments, the control block 163 may be configured to control the first interface 110 based on the number of errors detected by the second error detector 162. In various embodiments, the control block 163 is configured to request the external memory 200 for transmission of the mura correction data 300 when the number of errors exceeds a threshold value. In such embodiments, the control block 163 may fail to request the external memory 200 for transmission of the mura correction data 300 when the number of errors detected by the second error detector 162 is less than or equal to the threshold value. The threshold value may be determined depending on the specifications of the display driver 20.

In one or more embodiment, the counter 166 reset. For example, the count of errors of the counter 166 may be set to zero, may be achieved. In one or more embodiments, the control block 163 is configured to reset the count of errors when no error is detected in the mura correction data 300 received by the second error detector 162. In such embodiments, the control block 163 may be configured to control the first interface 110 to request the external memory 200 for transmission of the mura correction data 300 when the number of successive errors detected by the second error detector 162 exceeds a threshold value. Alternatively, the control block 163 may be configured to reset the count of errors when a predetermined period of time has elapsed. The control block 163 may be configured to reset the count of errors when the mura correction data 300 is outputted from the external memory 200 at boot or the like.

In one or more embodiments, the data check code 311 incorporated in the mura correction data 300 comprises a code which can correct an error such as an error correction code. In one or more embodiments, the second error detector 162 is configured to, when detecting a correctable error, output the error-corrected mura correction data 300 to the image processing circuitry 140 to continue the mura correction in the image processing circuitry 140. In one or more embodiments, the control block 163 may be configured to keep the mura correction stop signal disenabled when a correctable error is detected to continue the mura correction in the image processing circuitry 140.

In one or more embodiments, when the control block 163 can identify the location of an error in the mura correction data 300, the control block 163 may request the external memory 200 for transmission of the data block 310 for which the error is detected. In one or more embodiments, the control block 163 generates a signal to request the external memory 200 for transmission of the data block 310 for which the error is detected. In one or more embodiments, the first interface 110 obtains the relevant data block 310 from the external memory 200 based on the signal generated by the control block 163, and transfers the same to the internal memory 120. In one or more embodiments, the control block 163 can identify the location of the error when the data check code 311 is an error correction code or the like.

In one or more embodiments, when the mura correction data 300 comprises the block check codes 312 associated with the respective data blocks 310 as illustrated in FIG. 3, the second error detector 162 may detect an error in each of the data blocks 310. This allows the control block 163 to identify the data block 310 for which the error is detected. In such embodiments, the control block 163 may request the external memory 200 for transmission of the data block 310 for which the error is detected by controlling the first interface 110.

Although various embodiments have been specifically described herein, a person skilled in the art would appreciate that the technologies disclosed herein may be implemented with various modifications.

What is claimed is:

1. A display driver, comprising:

a first memory configured to store mura correction data;

image processing circuitry configured to perform mura correction on image data to be displayed on a display panel based on the mura correction data received from the first memory; and control circuitry configured to:

detect a first data corruption error in the mura correction data received from the first memory;

control a communication with a second memory storing the mura correction data based on the detection of the first data corruption error; and control the mura correction based on the detection of the first data corruption error, wherein controlling the mura correction comprises generating a mura correction stop signal based on the detection of the first data corruption error.

2. The display driver according to claim 1, wherein the control circuitry is configured to request the first memory for transmission of the mura correction data based on the detection of the first data corruption error.

3. The display driver according to claim 1, wherein the control circuitry is further configured to:

count a number of times a data corruption error is detected in the mura correction data; and request the second memory for transmission of the mura correction data based on the number of times.

4. The display driver according to claim 3, wherein the control circuitry is configured to count a number of times of successive data corruption errors detected in the mura correction data.

5. The display driver according to claim 1, wherein the control circuitry is further configured to detect a second data corruption error in the mura correction data outputted from the second memory to the first memory and control a communication with the second memory based on the detection of the second data corruption error.

6. The display driver according to claim 1, wherein the image processing circuitry is further configured to generate the image data to be displayed on the display panel without performing the mura correction, based on the mura correction stop signal.

7. The display driver according to claim 1, wherein the mura correction data comprises a code for error correction, wherein the control circuitry is configured to, when the first data corruption error is correctable, output an error-corrected mura correction data to the image processing circuitry and request the second memory for transmission of the mura correction data, the error-corrected mura correction data being obtained by correcting the first data corruption error in the mura correction data.

8. The display driver according to claim 1, wherein the mura correction data comprises a plurality of data blocks, and wherein each of the plurality of data blocks comprises a code for error detection.

9. The display driver according to claim 1, wherein the first memory is internal to the display driver and the second memory is external to the display driver.

10. A method, comprising:

generating image data to be displayed on a display panel through mura correction based on a mura correction data received from a first memory, wherein the mura correction data comprises a code for error correction;

detecting a first data corruption error in the mura correction data outputted from the first memory comprising:

when the first data corruption error is correctable, correcting the first data corruption error in the mura correction data; and controlling a communication with a second memory storing the mura correction data based on the detection of the first data corruption error, wherein controlling the communication comprises:

when the first data corruption error is correctable, requesting the second memory for transmission of the mura correction data.

11. The method according to claim 10, wherein controlling the communication comprises:

requesting the second memory for transmission of the mura correction data based on the detection of the first data corruption error.

12. The method according to claim 10, wherein controlling the communication comprises:

counting a number of times a data corruption error is detected in the mura correction data; and requesting the second memory for transmission of the mura correction data based on the number of times.

13. The method according to claim 12, wherein the number of times comprises a number of times of successive detection of data corruption error.

14. The method according to claim 10, further comprising:

detecting a second data corruption error in the mura correction data outputted from the second memory to the first memory, wherein controlling the communication comprises:

controlling the communication with the second memory based on the detection of the second data corruption error.

15. The method according to claim 10, further comprising:

controlling the mura correction based on the detection of the first data corruption error.

16. The method according to claim 10, wherein generating the image data comprises:

generating the image data to be displayed on the display panel without performing the mura correction based on the detection of the first data corruption error.

17. A display module, comprising:

a display panel;

a first memory configured to store a mura correction data;

image processing circuitry configured to perform mura correction on an image data to be displayed on the display panel based on the mura correction data received from the first memory; and control circuitry configured to:

detect a first data corruption error in the mura correction data outputted from the first memory;

control a communication with a second memory storing the mura correction data based on the detection of the first data corruption error; and detect a second data corruption error in the mura correction data outputted from the second memory to the first memory and control a communication with the second memory based on the detection of the second data corruption error.

18. The display module of claim 17, wherein the mura correction data comprises a code for error correction, and wherein the control circuitry is further configured to:

detect a third data corruption error in the mura correction data outputted from the first memory;

when the third data corruption error is correctable, output an error-corrected mura correction data to the image processing circuitry and request the second memory for transmission of the mura correction data, the error-corrected mura correction data being obtained by correcting the third data corruption error in the mura correction data.

19. The display module of claim 17, wherein the mura correction data comprises a plurality of data blocks, and wherein each of the plurality of data blocks comprises a code for error detection.

20. The display module of claim 17, wherein the first memory is internal to a display driver comprising the image processing circuitry and the control circuitry, and the second memory is external to the display driver.

* * * * *